US007766174B2

(12) United States Patent
Abraitis

(10) Patent No.: US 7,766,174 B2
(45) Date of Patent: Aug. 3, 2010

(54) EXPANDABLE SELF-DRAINING FOOTWEAR RACK

(75) Inventor: Vince Abraitis, 2-208 Emby Dr., Mississauga (CA) L5M 1H6

(73) Assignee: Vince Abraitis, Milton, Ontario (CA)

( * ) Notice: Subject to any disclaimer, the term of this patent is extended or adjusted under 35 U.S.C. 154(b) by 416 days.

(21) Appl. No.: 11/859,371

(22) Filed: Sep. 21, 2007

(65) Prior Publication Data

US 2008/0073300 A1 Mar. 27, 2008

Related U.S. Application Data

(60) Provisional application No. 60/846,440, filed on Sep. 22, 2006.

(51) Int. Cl.
*A47F 7/08* (2006.01)

(52) U.S. Cl. ..... 211/36

(58) Field of Classification Search ..... 211/34, 211/36, 37, 41.3, 186, 189, 188, 194; 108/24, 108/186, 180

See application file for complete search history.

(56) References Cited

U.S. PATENT DOCUMENTS

| | | | | |
|---|---|---|---|---|
| 591,377 | A | 12/1897 | Bunce | |
| 2,847,127 | A | 8/1958 | Glassenberg | |
| 3,022,897 | A * | 2/1962 | Archer et al. | 211/36 |
| 3,311,242 | A | 3/1967 | Miklya | |
| 3,587,864 | A | 6/1971 | Delisle | |
| 3,762,573 | A | 10/1973 | Collins et al. | |
| 4,200,993 | A | 5/1980 | Blanc et al. | |
| 4,843,975 | A * | 7/1989 | Welsch et al. | 108/24 |
| 4,997,093 | A * | 3/1991 | Letteri, Jr. | 211/119.008 |
| 5,026,128 | A * | 6/1991 | Groetzinger | 312/210.5 |
| 5,782,368 | A * | 7/1998 | Roberge | 211/194 |
| 6,079,339 | A * | 6/2000 | Houk et al. | 108/186 |
| 6,401,946 | B1 * | 6/2002 | Chalasani et al. | 211/188 |
| 6,491,170 | B1 * | 12/2002 | Madela | 211/41.3 |
| 6,772,889 | B2 * | 8/2004 | Moceri | 211/90.04 |
| 7,658,154 | B2 * | 2/2010 | Yankello et al. | 108/190 |
| 7,669,721 | B2 * | 3/2010 | Kemper et al. | 211/41.3 |
| 2002/0179551 | A1 * | 12/2002 | Madela | 211/41.3 |
| 2005/0194338 | A1 | 9/2005 | Firth | |
| 2005/0205499 | A1 | 9/2005 | Botner | |
| 2005/0252869 | A1 | 11/2005 | Graham | |
| 2006/0091087 | A1 | 5/2006 | Belanger et al. | |
| 2009/0039747 | A1 * | 2/2009 | Webster et al. | 312/334.1 |
| 2010/0059460 | A1 * | 3/2010 | Mulaw | 211/41.3 |

* cited by examiner

*Primary Examiner*—Jennifer E. Novosad

(57) ABSTRACT

A rack for supporting footwear and handling footwear drainage, the rack comprising a base member having a tray opening, a tray slidably removable from the base member through the tray opening, a shelf supported on the base member and wherein the shelf has drain spouts openings that are in fluid communication with the tray. Hollow support legs are provided having first and second ends, and the first ends of the support legs are interlocked to the drain spouts. Another shelf is stacked on the second ends of the support legs. Additional shelves may be stacked thereon to increase the height of the rack.

14 Claims, 8 Drawing Sheets

EXPANDABLE SELF-DRAINING FOOTWEAR RACK

CROSS REFERENCE TO RELATED APPLICATION

This application claims priority to U.S. provisional patent application Ser. No. 60/846,440, filed Sep. 22, 2006 to Abraitis, entitled Expandable Self-Draining Boot Rack, the contents of which are hereby incorporated by reference.

BACKGROUND

The storage of footwear storage has long been a problem. This is due to the fact that people have many different pairs of shoes, some for outdoor activities, some for formal occasions, some for work, some for play, etc. The shoes become increasingly difficult to manage, especially in large families.

Another problem associated with footwear occurs when the footwear is wet, dirty and/or packed or encased in snow and ice. In a typical winter, a boot will be worn as the person walks through snow, slush, muddy slush, and snow and slush carrying a load of ice melting materials, for example salt. In addition, many boots have deep lug-type treads so that the wearer will have traction. As a result, the lugs become packed with mud, salt, ice, snow and anything else the person happened to step on.

A significant problem exists when these boots thaw out and the ice and snow melts. If the boots are permitted to thaw on carpeting, the carpeting may very well become stained and ruined. Standing the boots on a concrete slab in, for example a garage, does not solve the problem, because when the snow load melts there will be a puddle, and when the puddle dries there will be stains. The same can be said with respect to footwear that coated in oil, dirt or other fluids. They too must drain and the same problems are encountered.

Thus, there is a need for a device for handling the flow from draining footwear that is easy to use, easy to clean and can accommodate drainage fluid.

SUMMARY

The expandable self-draining boot rack invention solves the problems associated with footwear storage and drainage. The footwear which the invention may be used with includes boots, shoes, sneakers, etc. The expandable self draining boot rack comprises a base member having a tray opening, and a tray that is slidably removable from the base member and guided by guide members. A shelf is supported on the base member and the shelf has drain spouts each having openings that are fluid communication with the tray. The shelf may have an edge lip with an alignment member and for aligning the shelf and base member during assembly of the rack and for preventing the shelf from sliding off the base member. The drain spouts are for receiving drainage flowing off the shelf. In one of the preferred embodiments the tray has a drainage channel that extends from one drain spout to another and the channel is for directing drainage to the drain spouts. The tray has lock members for interlocking with support legs and the drains have a stop walls for supporting the support legs. The lock members are adjacent the drain spouts.

The support legs are hollow and have opposed first and second ends, and a first portion that meets with a second portion at a step. The step may be annular. The first end of the support legs have spaced apart first and second key edges that define a leg side opening such that the support legs are capable of being keyed or interlocked to the lock members of the tray.

The support leg step abuts against the stop wall of the drain when the support leg is interlocked with the tray. The second ends of the support legs are for supporting a vertically disposed shelf. As many shelves as desired may be stacked on top of one another.

There is also a method of making a rack for supporting footwear comprising providing a base member having a tray opening, providing a tray that is slidably removable from the base member through the tray opening, providing a shelf and positioning the shelf on the base member. The method includes providing the shelf with drain spouts with openings, and an edge lip that may have an alignment member for aligning the shelf and base member. In one of the preferred embodiments the method further includes and providing the shelf with a drainage channel and extending the drainage channel from one drain spout to another in spout in order that the channel may direct the flow of drainage. The method includes providing hollow support legs with opposed first and second ends and key edges that define a side opening, and providing the tray with lock members. The method includes and keying or interlocking the support legs to the tray. The method may include providing the support leg with a first portion with a first surface from which extends a second portion with a second surface and extending a step from the first surface to the second surface, and abutting the step against the stop wall of the drain spout to support the support leg in the drain spout. The method includes stacking another shelf on the second ends of the support legs and the method may include repeating the stacking process with more shelves and support legs until a desired vertical height is reached.

BRIEF DESCRIPTION OF THE DRAWING FIGURES

The invention is illustrated in the drawings in which like reference characters designate the same or similar parts, surfaces or features throughout the figures of which:

DESCRIPTION

Figure 1:
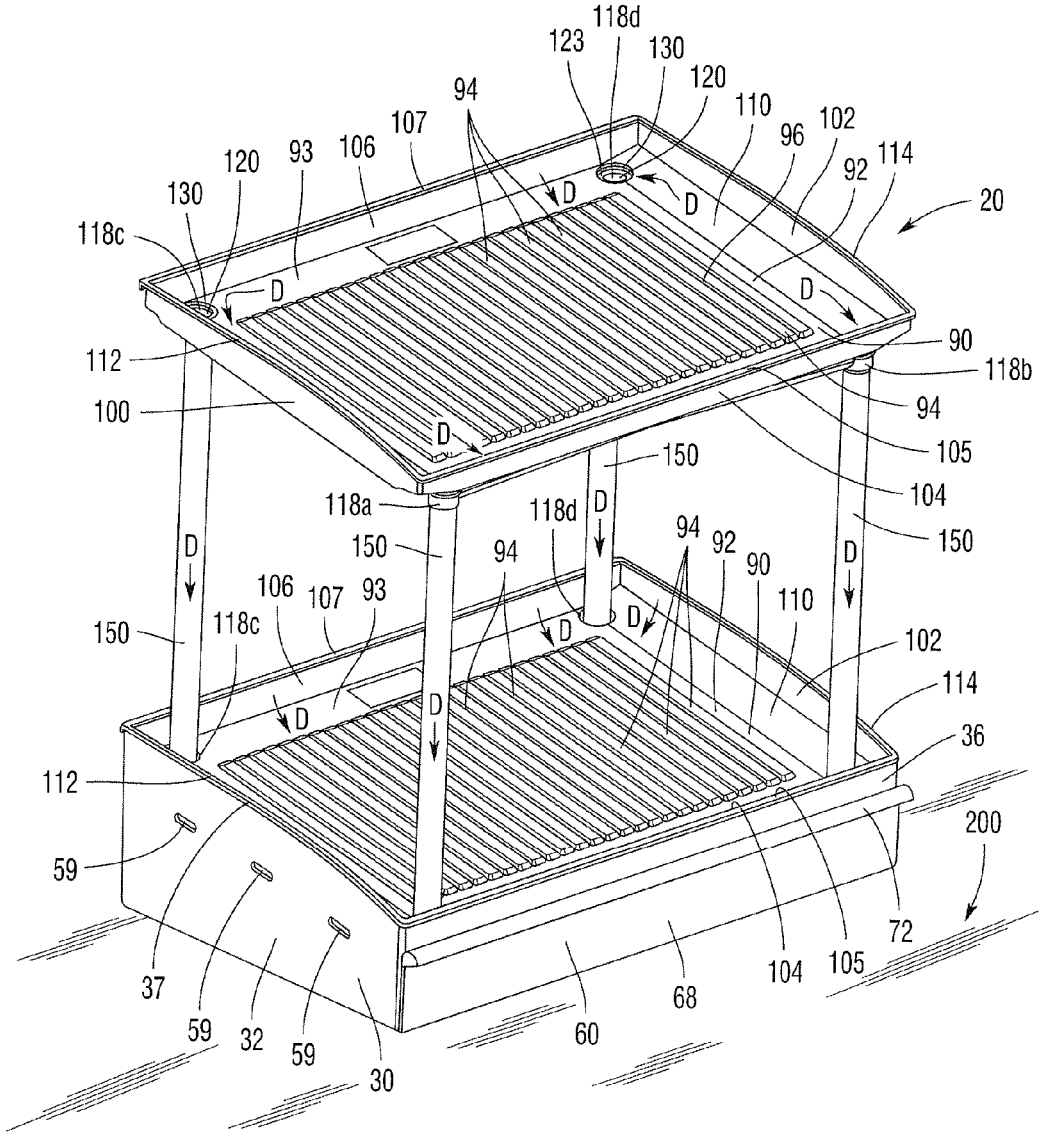
FIG. 1 is a perspective view of a self-draining boot rack.
Figure 2:
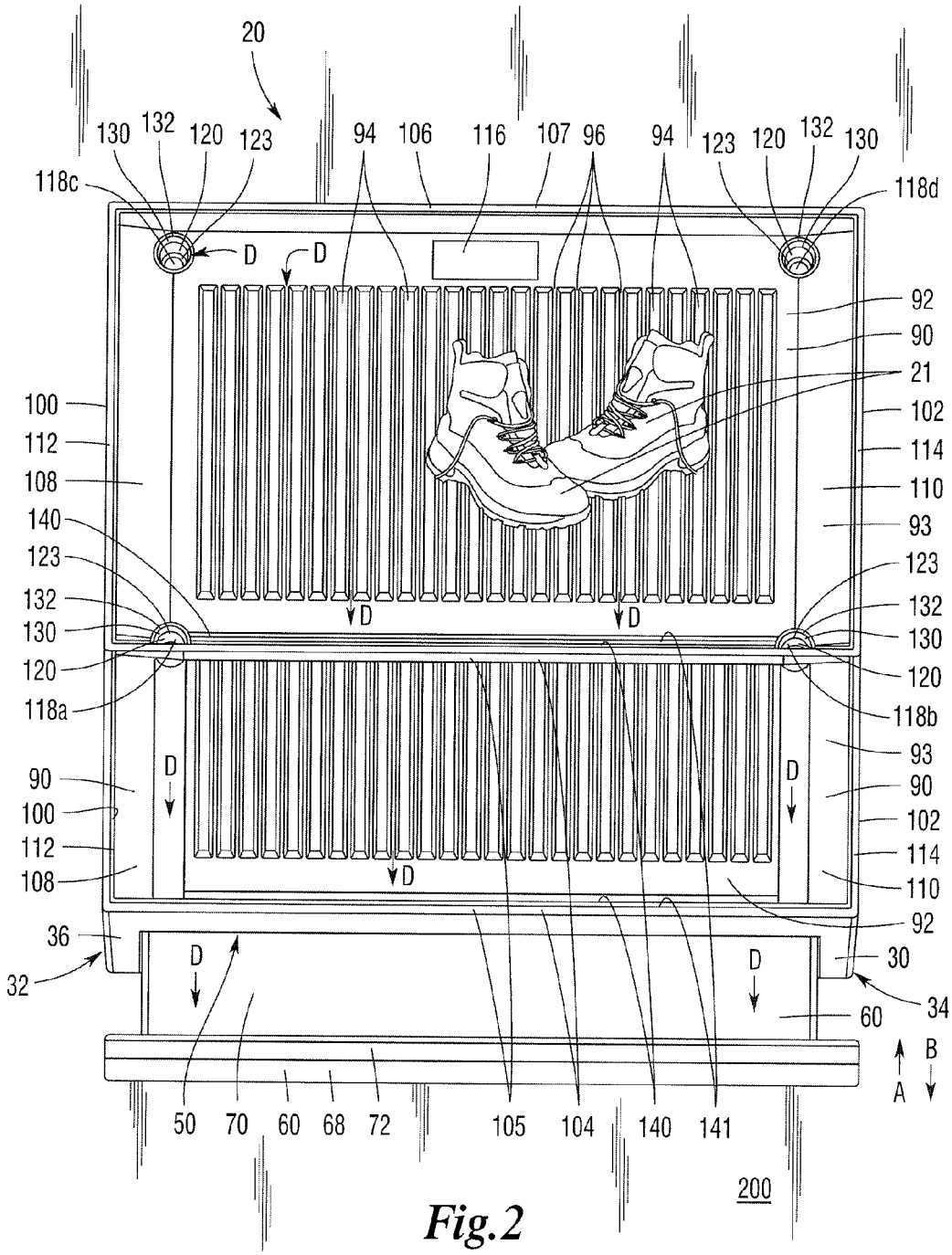
FIG. 2 is a front top perspective view of the self-draining boot rack showing a tray partly withdrawn from a base member.
Figure 3:
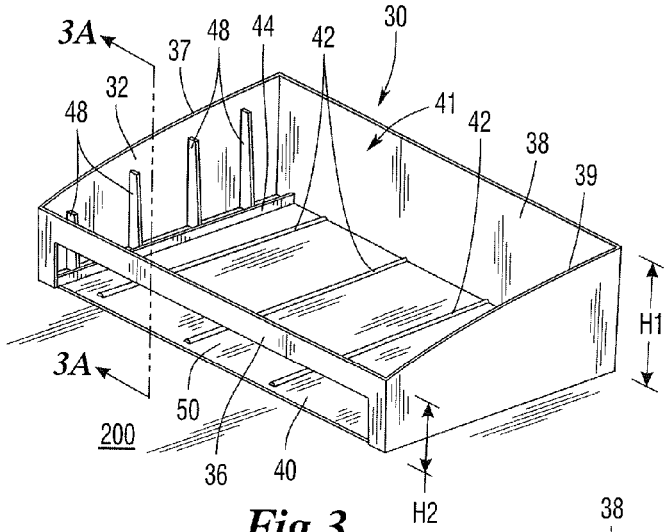
FIG. 3 is a perspective view of a base member of the boot rack.
Figure 3A:
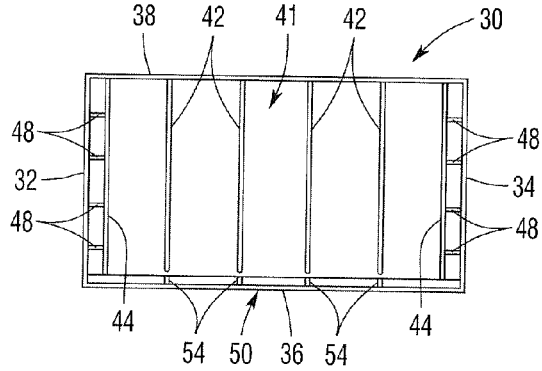
FIG. 3A is a top plan view of the base member of the boot rack.
Figure 4:
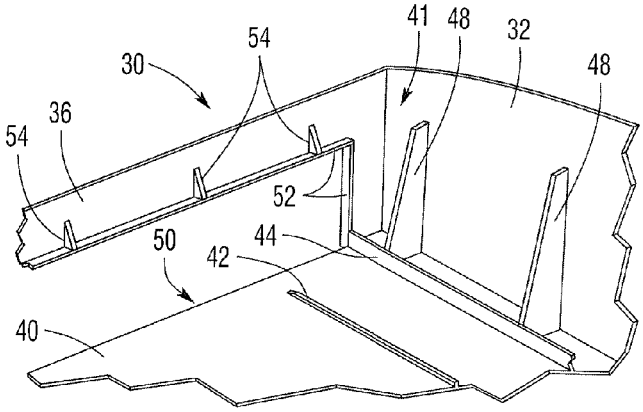
FIG. 4 is a section view of the base member taken along line 3A-3A of FIG. 3.
Figure 11:
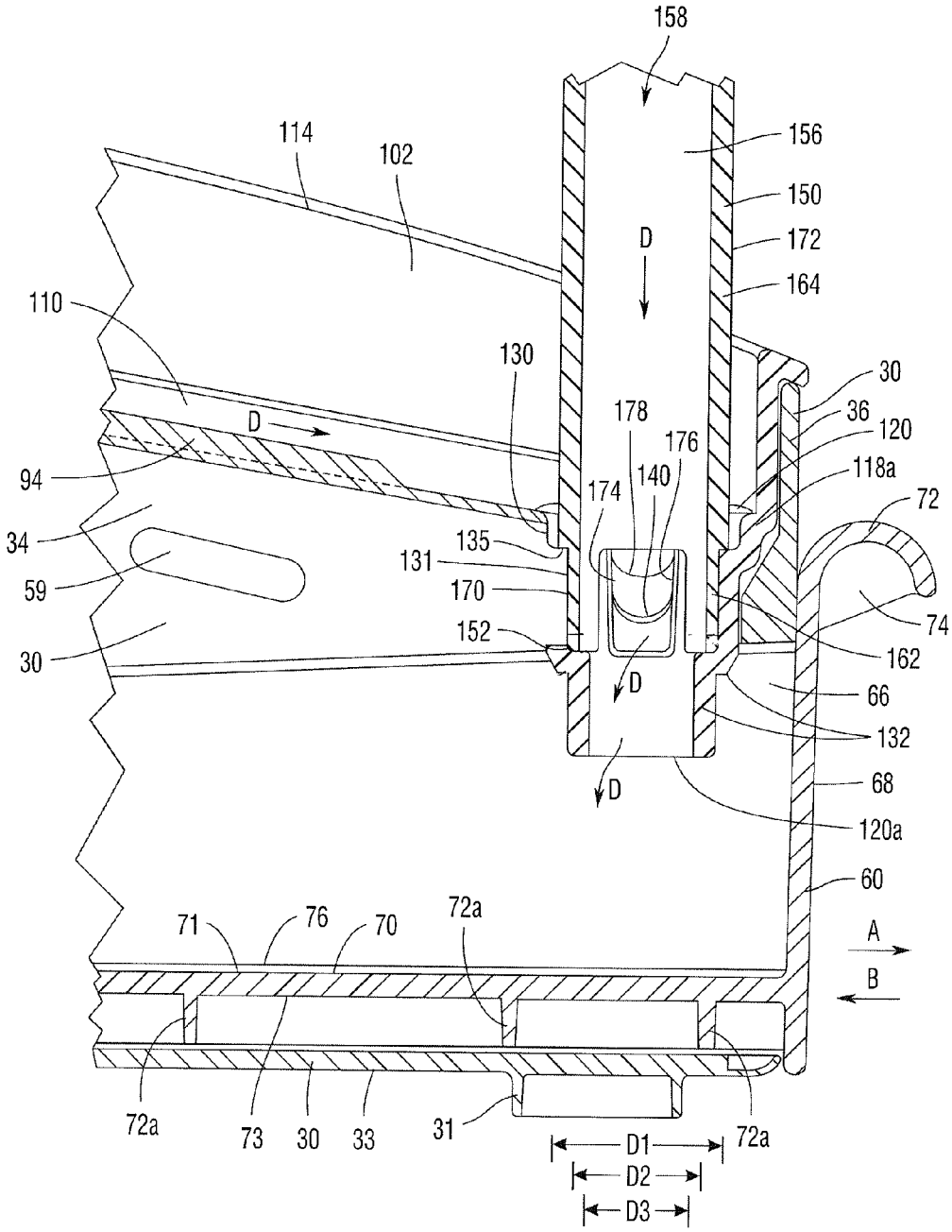
FIG. 11 is a sectional view of the shelf, leg and tray when assembled.

As shown in FIGS. 1-4, there is a expandable self draining boot rack 20 (also referred to herein as rack 20) on which foot ware, shoes and boots, commonly designated 21, are supported. The boot rack 20 has a base member 30 with facing first and second side walls 32, 34, respectively, facing third and forth side walls 36, 38, respectively, which are joined to and extend from a base wall 40. The base member 30 has a shelf receiving opening 41 opposite the base wall 40. As shown in FIG. 3A, the base wall 40 has base ribs 42 that are perpendicular to the fourth side wall 38. A pair of tray guides 44 extend from the base wall 40, and extend from the third side wall 36 to the fourth side wall 38 and are adjacent the first and second side walls 32, 34. The first and second side walls 32, 34, may have side wall ribs 48 that are perpendicular to the base wall 40 for providing strength. And, the height of the first and second side walls 32, 34, deceases as they approach the third and fourth side walls 36, 38, and they each have a curved edge 37, 39, respectively. The curved edges 37, 39 are convex, as shown. The third wall 36 has a tray opening 50 that is sized to receive a tray 60 as will be described presently. Extending from the third wall 36 is a peripheral rib 52 that surrounds the tray opening 50, and there may be reinforcing elements 54 extending from the third wall 36 to the peripheral rib 52. The base member 30 may have supports 31 extending from the exterior side 33 thereof for providing support, as shown in FIG. 11. As shown in FIGS. 1 and 11, the base member 30 may also be provided with vent openings 59 to foster evaporation of drainage water or fluids.

Figure 5:
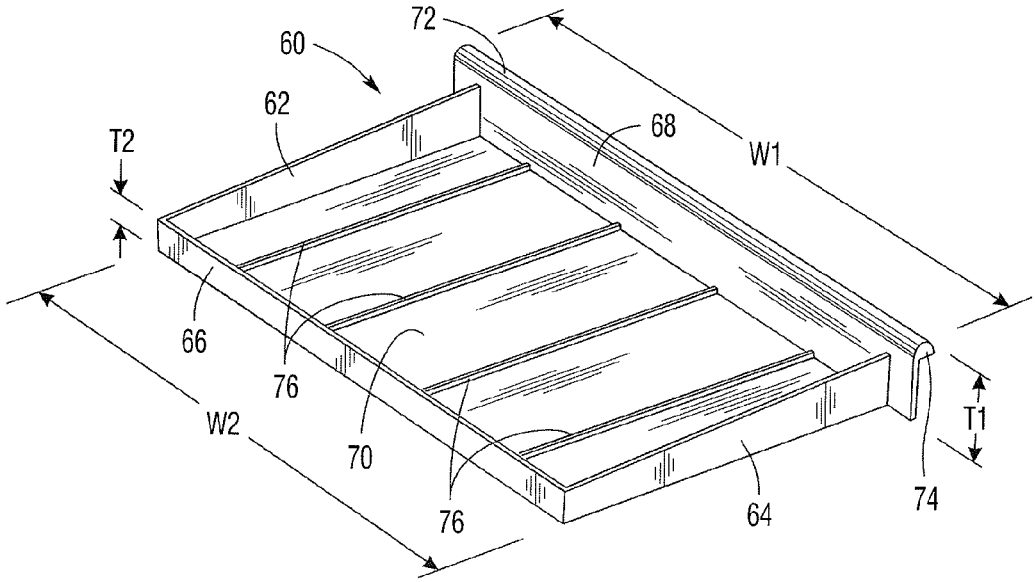
FIG. 5 is a top rear perspective view of a tray.
Figure 6:
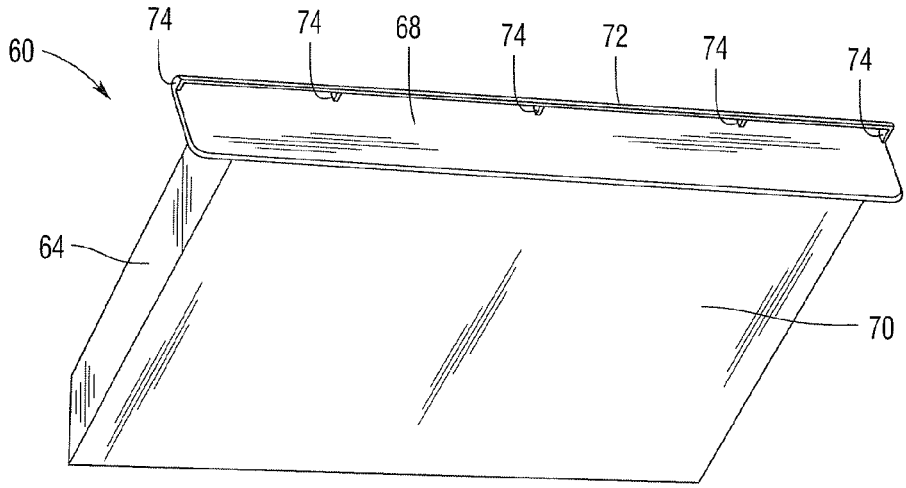
FIG. 6 is a bottom left perspective view of the tray.

As shown in FIGS. 5 and 6, there is a tray 60 for being slid in and out of the tray opening 50 in the third wall 36. The tray 60 has opposed first and second tray walls 62, 64, respectively, and opposed third and fourth tray walls 66, 68, respectively, each of which extends from a tray base 70. The height designated T1 of the third tray wall 66 is less than the height designated T2 of the fourth tray wall 68. The tray base 70 may have ribs 76 for added strength, and the ribs 76 may extend from either a first side 71 of the tray base as shown in FIG. 5, or alternatively, ribs 72*a* may extend from the opposed second side 73 of the tray base 70 as shown in FIG. 11. The first and second tray walls 62, 64, increase in height as they approach the fourth tray wall 68. The width designated W1 in FIG. 5 of the fourth tray wall 68 is greater than the width W2 of the third tray wall 66, such that the fourth wall 68 extends beyond the first and second walls 62, 64, and extends vertically above the first and second walls 62, 64, to close the opening 50 in the base member 30 when the tray 60 is fully introduced into the base member 30, as shown in FIG. 1. The fourth tray wall 68 has a handle portion 72 that is disposed vertically above the first and second walls 62, 64, and the handle portion 72 may have support ribs 74 for increased strength. The tray 60 is slid out and in of the base member 30 in the direction of arrows A and B as shown in FIG. 2 and throughout the drawing figures and is guided by the tray guides 44. In FIG. 2, the tray 60 is partly withdrawn from the base member 30, whereas in FIG. 1, the tray 60 is disposed completely in the base member 30.

As shown in FIGS. 1, 2, 7, 8, 10 and 11 there is a shelf 90 on which shoes, boots and footwear 21 are placed. FIGS. 1 and 2 show two shelves 90. The shelves 90 are structurally identical and interchangeable with one another. The shelf 90 has opposed first and second shelf sides 93, 95, respectively. The shelf 90 has a shelf base 92 with raised ribs 94 extending from the first shelf side 93 for supporting the footwear. Extending between the ribs 94 are flow paths 96 which serve as flow paths for water/fluids that drip from the footwear, for example melt water from snow, rain water or water carrying a load of mud, oil, etc. Other patterns are possible for allowing for the drainage of fluids, for example a rippled pattern or elevated checkerboard pattern (not shown). The second side of the shelf 90 may have a web 97 that is formed as part of the shelf 90 to provide support, such that the shelf 90 will not deflect or sag under a load of footwear.

Figure 7:
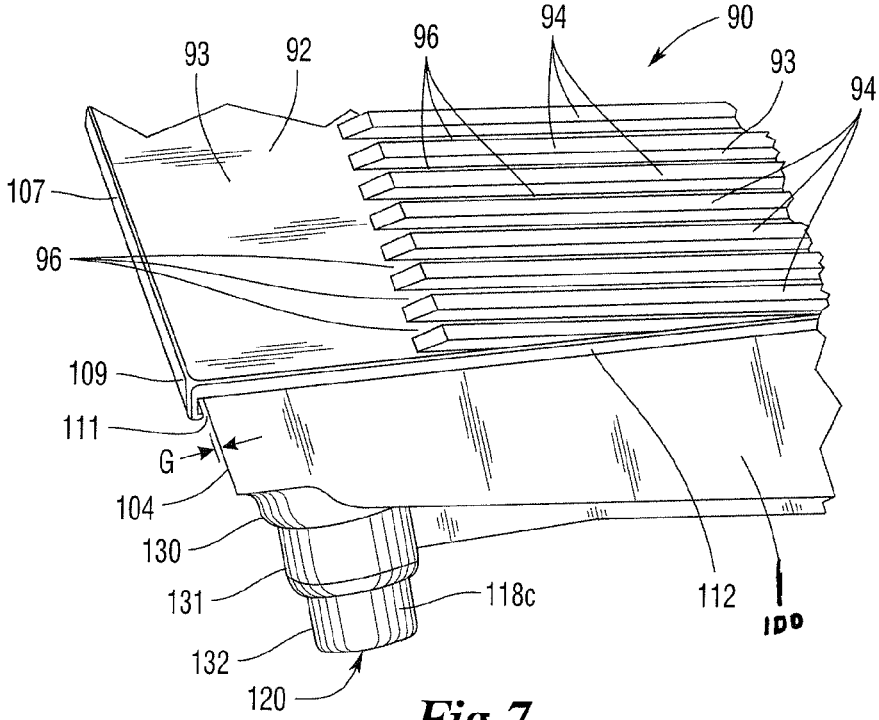
FIG. 7 is a front elevational view of a portion of a shelf.

As shown in FIGS. 1 and 2, the shelf 90 has opposed first and second shelf walls 100, 102, respectively, that extend from and are joined to the shelf base 92, and opposed third and fourth shelf walls 104, 106, respectively, that extend from and are joined to the shelf base 92. The shelf base 92 has first and second sloped base portions 108, 110 respectively, to facilitate drainage. In addition, each of the first and second shelf walls 100, 102 has an edge lip 112, 114, respectively, that has a convex curvature that is substantially the same, i.e., matches, the convex curvature of the and first and second side walls 32, 34, of the base member 30, in order that the shelf 90 is capable of being supported on the base member 30 by way of the upper edge lips 112, 114, as shown in FIGS. 1 and 2. The third shelf wall 104 has an edge lip 105 such that is capable of being supported on the third wall 36 of the base member 30. The fourth shelf wall 106 has an edge lip 107, and an alignment member 109 depends from the edge lip 107 of the fourth shelf wall 106, as shown in FIGS. 1 and 7. A shelf receiving gap 111, designated G in FIG. 7, extends from the fourth shelf wall 106 to the alignment member 109. The shelf receiving gap 111 is sized to receive the fourth side wall 38 of the base member 30 therein, such that when the shelf 90 is fitted on the base member 30 and received in the shelf receiving opening 41 of the base member 30 it is aligned and it is held in position thereon. When the shelf 90 is positioned on the base member 30 it is sloped in a direction toward the third side wall 36 of the base member 30, which allows gravity forces to cause drainage fluid to flow in a direction toward a drainage channel 144 and off the shelf 90, as will be described presently. The slope of the shelf 90 is due to the fact that the fourth side wall 38 of the base member 30 has a height H1 that is greater than a height H2 of the third side wall 36 of the base member 30, as shown in FIG. 3. The degree of the slope may be varied by changing the relative heights of the third and fourth side walls 36, 38 of the base member 30. In one of the preferred embodiments, the base 92 of the shelf 90 is at about a 40° angle to the base wall 40 or support surface 200, for example the floor. The slope of the shelf 90 advantageously enhances the drainage of fluid off the shelf 90.

Figure 10:
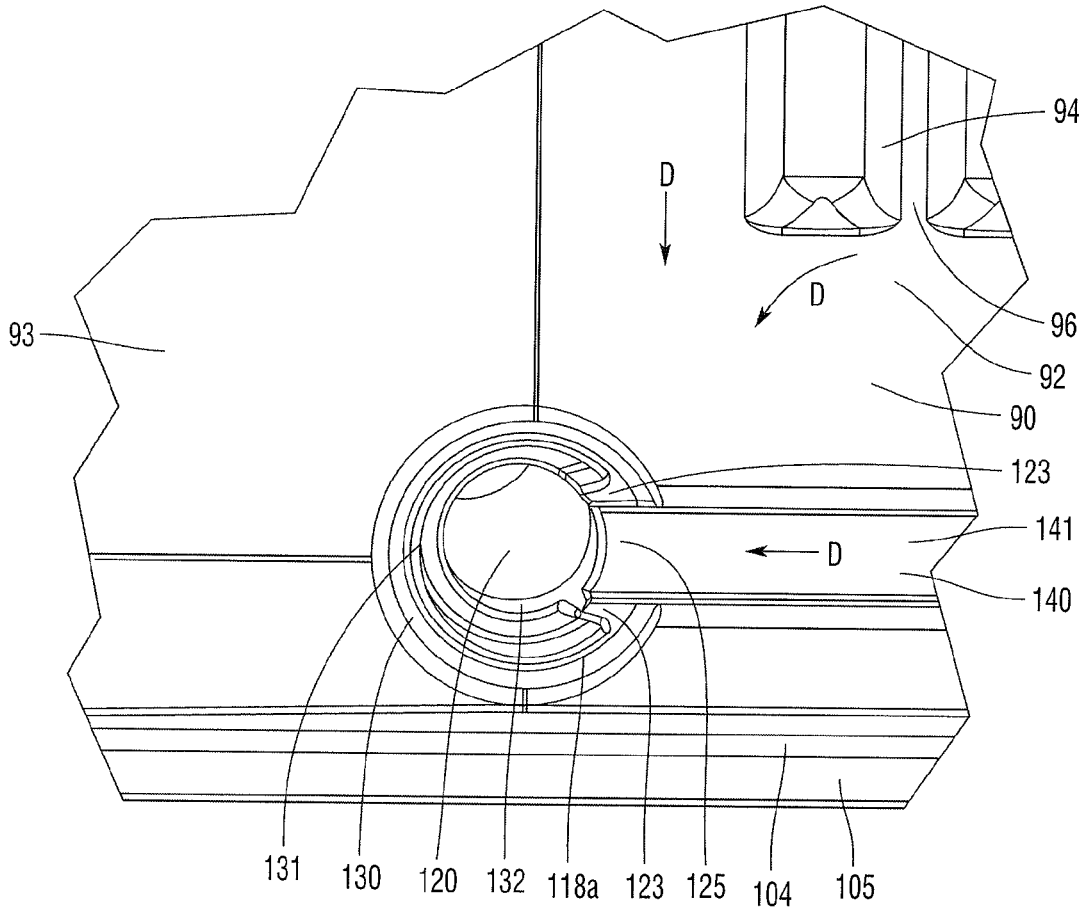
FIG. 10 is an enlarged top plan view of a portion of the shelf of FIG. 2.

As shown in FIGS. 2, 7, 8, 10 and 11, extending from the second side 93 of the shelf 90 are first, second, third and fourth drain spouts 118*a*, 118*b*, 118*c*, 118*d*, respectively, with openings 120. Each of the first, second, third and fourth drain spouts 118*a*, 118*b*, 118*c*, 118*d*, has a first portion 130 having a first internal diameter D1 that meets with a second portion 131 having a second internal diameter D2 that is less than D1, and a third portion 132 having an internal diameter D3 that is less than that of D2. Where the first and second portions 130, 131 meet there is a stop wall 135. In addition, the shelf 90 has lock members 123 for interlocking with connecting legs 150 in a manner to be described presently. FIG. 10 shows a pair of lock members 123. The lock members 123 are adjacent the first, second, third, and fourth drain spouts 118*a*, 118*b*, 118*c*, and 118*d*. In other preferred embodiments, the tray 60 may have lock members 123 adjacent to just the first and second drains 118*a*, 118*b* or may embodied with one lock member 123 adjacent each drain spout.

Figure 8:
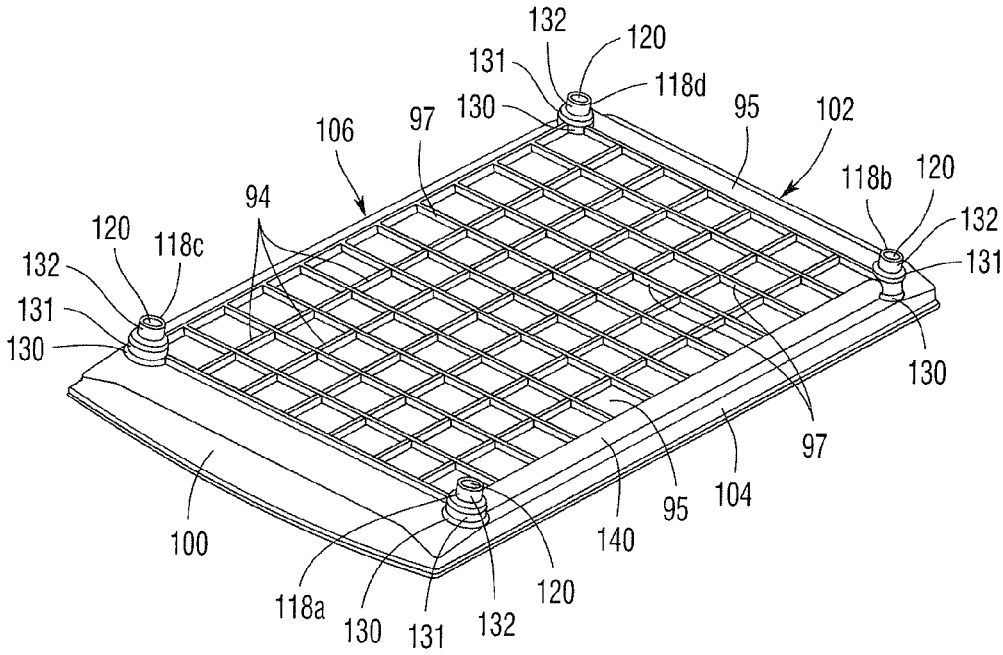
FIG. 8 is a bottom plan view of the shelf.

As shown in FIGS. 2, 8 and 10, in one of the preferred embodiments the shelf 90 is formed with a drainage channel 140 (also referred to herein as gutter 140) having a channel flow path 141. The drainage channel 140 extends along the third side wall 104 of the shelf 90 and is recessed relative to the third side wall 104 and the shelf base 92. The drainage channel 140 extends between the first and second drain spouts 118*a*, 118*b*. In addition, each of the first and second drain spouts 118*a*, 118*b*, has a side opening 125 in the second portions 131 thereof, and the side opening 125 is in fluid communication with the drainage channel 140. The third and fourth drain spouts 118*c* and 118*d* do not have such an side opening 125, because no drainage channel 140 extends between them. Thus, the drainage channel 140 is in fluid communication with the drain opening 120 in the first and second drain spouts 118*a*, 118*b* through the side openings 125. Drainage fluid flowing from the shelf 90 may enter any of the drain openings 120 and be directed to the any of the first, second, third and fourth drain spouts 118*a*, 118*b*, 118*c*, 118*d*, or may enter the drainage channel 140, flow along the flow path 141 and be directed to the first and second drain spouts 118*a*, 118*b*. It is pointed out that there may be a structurally identical drainage channel 140 that extends from the third drain spout 118*c* to the fourth drain spout 118*d*, in which case the third and fourth drain spouts 118*c* and 118*d* would have side openings 125 so as to be in fluid communication with the drainage channel 140. The shelf base 90 may have a label recess 116 for receiving a label (not shown) or other printed indicia, or printed indicia may be formed in the shelf base 92.

Figure 9:
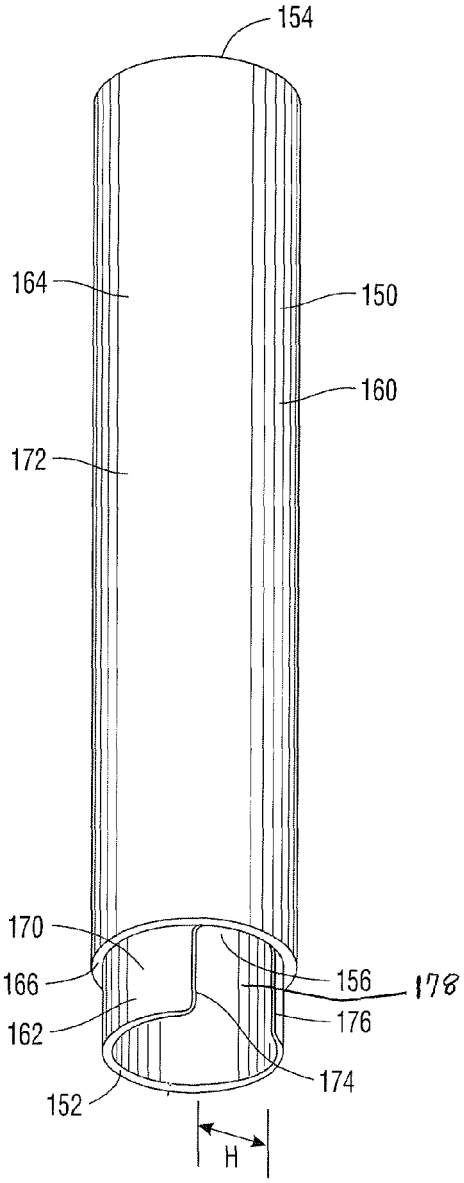
FIG. 9 is a perspective view of a support leg.
Figure 9A:
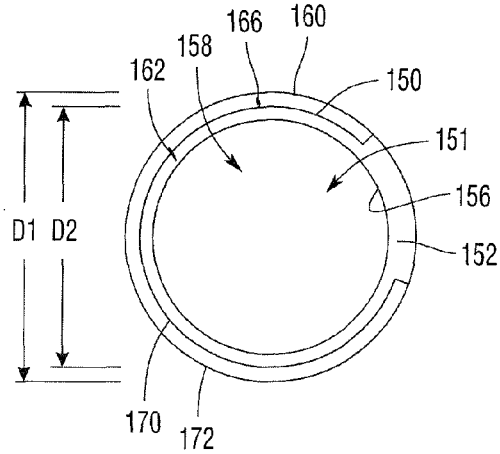
FIG. 9A is a left side elevational view of the support leg.
Figure 9B:
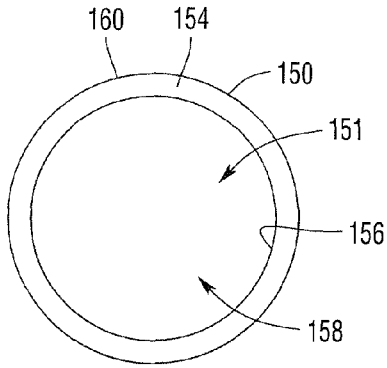
FIG. 9B is a right side elevational view of the support leg.

Shown in FIGS. 9, 9A and 9B is a support leg 150, and the assembled boot rack 20 has four support legs 150. Each support leg 150 has opposed first and second support leg ends 152, 154, respectively, with a longitudinal opening 151 extending therethrough. The support leg 150 has an interior surface 156 that defines an support leg flow path 158 that extends through the support leg 150, such that the support leg 150 is hollow. The support leg 150 has a first portion 162 having an outer diameter D1 which extends from a second portion 164 having a outer diameter D2 that is greater than D1. A step 166 extends from a first outer surface 170 of the first portion 162 to a second outer surface 172 of the second portion 164. The leg wall 166 may have an annular shape. The first portion 162 has spaced apart first and second leg key edges 174, 176, respectively, that define a leg side opening 178, designated H in FIG. 9, in the support leg 150. The first and second key edges 174, 176, extend from the first support end 152 to the step 166. As shown, the support leg 150 may be in the general shape of a right cylinder with a circular cross section, but may have other geometries. In addition, because the support leg 150 is hollow fluid is capable of flowing through the support leg 150. As shown in FIGS. 1 and 2, the second support leg ends 154 have an internal diameter greater than an external diameter of at least a portion of the first, second, third and fourth drain spouts 118*a*, 118*b*, 118*c* and 118*d*, such that the drain spouts may be received therein. The support legs 150 may have any desired length.

Each of the base member 30, tray 60, shelf 90 and support leg 150 may comprise plastic, wood, composites, metal, for example aluminum, fiberglass and combinations thereof.

In use the expandable self draining boot rack 20 the base member 30 is placed on the support surface 200. Next, the shelf 90 is positioned over the base member 30 such that the edge lips 112, 114, of the first and second shelf walls 100, 102 are disposed vertically above the first and second side walls 32, 34, of the base member 30, and the edge lips 105, 107 of the third and fourth shelf walls 104 106 are disposed vertically above the third and fourth side walls 36, 38 of the base member 30. The shelf 90 is lowed onto the base member 30 such that the fourth side wall 38 of the base member 30 is disposed in the gap 111 and the shelf 90 is aligned and held in position by the alignment member 109. Upon placing the shelf 90 on the base member 30 in the above-described manner and sliding the tray into the opening 50, the assembled unit is ready for use, and footwear may be placed on the shelf 90 and drainage water collected in the tray 60. In particular, drainage fluid (indicated by the arrows designated D throughout the drawing figures) flows off the shelf 90 in the direction of the arrows designated D, into the channel 140, through the openings 120 in the first and second drain openings 118*a*, 118*b*, and into the tray 60, and drainage flows through the openings 120 in the third and fourth drain spouts 118*c*, 118*d*, and into the tray 60. It is pointed out that prior to placement of the shelf 90 on the base member, the shelf 90 may be rotated 180° from the orientation described above and it will still be possible to place the shelf 90 on the base member 30, because the shelf is reversible. The tray 60 is then slid in and out of the opening 50 in the base member 30 in the direction of the arrows A and B as required to dispose of drainage fluid accumulated in the tray 60 or to wash the tray 60.

Additional shelves 90 are stacked vertically above the shelf 90 supported on the base member 30 with the support legs 150, so that additional footwear may be stored and properly drained. In order to add another shelf 90, the first ends 152 of the four support legs 150 are fitted in the openings 120 in the shelf 90 supported on the base member 30 and keyed to the shelf 90 such that the support legs 150 are joined to the shelf 90. In particular, the key edges 174, 176 of each of the support legs 150 are aligned with the lock members 123 of the shelf 90 that are adjacent to each of the first, second, third and fourth drain spouts 118*a*, 118*b*, 118*c*, and 118*d*, and the support legs 150 are moved into the first, second, third and forth drain spouts 118*a*, 118*b*, 118*c*, 118*d* and interlocked or keyed to the shelf 90. If the support legs 150 are not properly aligned with the shelf 90, then it will not be possible to move the first ends 152 of the support legs 150 into the shelf 90 due to the presence of the lock members 123. The first ends 152 of the support legs 150 abut against and are supported by the stop wall 135 in each of the first, second, third and fourth drains 118*a*, 118*b*, 118*c* and 118*d*.

When the support leg 150 is interlocked with the tray 90 supported on the base member 30, the side opening 178 in the support leg 150 is aligned with the channel 140 in the shelf 90, such that drainage fluid will flow off the shelf 90, into the channel 140, through the side openings 178 in the support legs 150, into the openings 120 in the first and second drain spouts 118*a*, 118*b* and into the tray 60. Similarly, drainage fluid will flow off the shelf 90 supported on the base member 30, through the side openings 178 in the support legs 150, through the third and fourth drain spouts 118*c* and 118*d* and into the tray 60. The support legs 150 do not obstruct fluid flow, because of the side opening 178 in each of the support legs 150 allow for the drainage of fluid off the shelf 90 supported on the base member 30.

Then, after the support legs 150 are joined to the shelf 90 supported on the base member 30, another shelf 90 is aligned with the second ends 154 of the support legs 150 and the first, second, third and fourth drain spouts 118*a*, 118*b*, 118*c*, and 118*d* are moved into the second ends 154 of the support legs 150, such that the second ends 154 of the support legs 150 abut the shelf 90. Drainage from the shelf 90 supported on the support legs 150 flows off the shelf 90 in the manner described above, and in addition flows through the support legs 150, through the first, second, third and forth drain spouts 118*a*, 118*b*, 118*c*, and 118*d* of the shelf 90 supported on the base member 30, and into the tray 60. Additional shelves 90 may be stacked on the top of the shelf 90 with the use of additional support legs 150 in the same manner as described above to stack as many shelves 90 on top of one another as needed or desired, such that the rack 20 is expandable. The tray 60 is pulled out of the base member 60 to empty and clean it as necessary.

Thus, the expandable boot rack 20 advantageously provides for drainage of fluids of all kinds that are collected in a removable tray 60, shelves 90 that may be readily added or removed with out the use of tools, shelves 90 that may be stacked upon one another and secured to one another without the need for separate fasteners or connectors that may become lost and without the need for tools. As another advantage, the rack 20 may be quickly assembled and disassembled without the need for tools, and may be disassembled for storage. In addition, because the height designated T1 of the third tray wall 66 is less than the height designated T2 of the fourth tray wall 68, the tray 60 may be advantageously withdrawn and introduced into the base member 60 without contacting any of the first, second, third and fourth drain spouts 118*a*, 118*b*, 118*c* and 118*d*.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed:

1. A rack for supporting footwear and controlling footwear drainage, the rack comprising:

a base member having a tray opening;

a tray slidably removable from the base member through the tray opening;

a shelf supported on the base member and wherein the shelf has at least one drain spout with an opening that is fluid communication with the tray, and the at least one drain spout for receiving drainage flowing off the shelf and the tray for receiving drainage flowing through the at least one drain spout; further including at least one support leg having opposed first and second ends, and wherein the shelf is interlocked to the first end and wherein the at least one support leg is for supporting another shelf;

the shelf has at least one lock member and the first end of the at least one support leg is interlocked to the at least one lock member;

the at least one support leg has first and second key edges that are interlocked to the at least one lock member to interlock the at least one of support leg and the shelf;

and the first and second key edges define a side opening in the at least one support leg and wherein the side opening is for allowing the flow of drainage fluid.

2. The rack according to claim 1 wherein the at least one drain spout includes first and second drain spouts and the tray has a drainage channel that extends from the first drain spout to the second drain spout and the drainage channel for directing drainage to the first and second drain spouts.

3. The rack according to claim 1 wherein the base member has a base wall and a pair of tray guides extending from the base wall and the tray guides for guiding the introduction and removal of the tray from the base member.

4. The rack according to claim 1 wherein the tray has a tray base with opposed third and fourth tray walls wherein the third tray wall is less than the height of the fourth tray wall in order that the tray is capable of being withdrawn from the base member without contacting the at least one drain.

5. The rack according to claim 1 wherein the shelf has a drainage channel and the side opening in the at least one support leg is aligned with the drainage channel such that the drainage channel is in fluid communication with the drain and the tray through the side opening in the at least one support leg.

6. The rack according to claim 1 wherein the at least one support leg includes four support legs each being interlocked to the shelf and each supporting another shelf disposed vertically above the shelf.

7. The rack according to claim 1 wherein the at least one drain spout has a stop wall and the at least one support leg abuts the stop wall such that it is supported thereon.

8. The rack according to claim 1 wherein the shelf has an edge lip with an alignment member and the alignment member for aligning the shelf and base member during assembly of the rack.

9. A method of supporting footwear comprising:

providing a base member having a tray opening;

providing a tray that is slidably removable from the base member through the tray opening;

providing a shelf and positioning the shelf on the base member and providing the shelf with at least one drain spout with an opening that is fluid communication with the tray, and wherein the drain spout is for receiving drainage flowing off the shelf and the tray is for receiving drainage flowing through the drain; further including interlocking the tray with at least one support leg and wherein the at least one support leg is for supporting another tray;

providing the tray with at least one lock member and providing the at least one support leg with key edges and interlocking the at least one lock member with the key edges to join the tray and at least one leg;

and defining a side opening in the at least one leg with the first and second key edges and wherein the side opening is for allowing the flow of drainage fluid off the shelf to enter the at least one leg.

10. The method of supporting footwear according to claim 9 further wherein the at least one drain spout includes a first drain spout and a second drain spout and providing the tray with a drainage channel and extending the drainage channel from the first drain spout to the second drain spout, and the drainage channel for directing drainage to the first and second drain spouts.

11. The method of supporting footwear according to claim 9 further including providing the base member with a base wall and a pair of tray guides that extend from the base wall and using the tray guides for guiding the introduction and removal of the tray from the base member.

12. The method of supporting footwear according to claim 9 further including providing the tray with a tray base and providing opposed third and fourth tray walls extending from the tray base and wherein the third tray wall is less than the height of the fourth tray wall in order that the tray is capable of being introduced and withdrawn from the base member without contacting the at least one drain.

13. The method of supporting footwear according to claim 9 further including providing the shelf with a drainage channel and wherein the side opening in the at least one support leg is aligned with the drainage channel such that the drainage channel is in fluid communication with the tray and the at least one drain through the side opening in the at least one support leg.

14. The method of supporting footwear according to claim 9 further wherein the step of providing the at least one support leg includes providing four support legs and the step of providing at least one drain includes providing the shelf with four drains and interlocking the four support legs to the shelf and positioning another shelf on the four support legs such that the another shelf is disposed vertically above the shelf.

* * * * *